US009985389B1

(12) United States Patent
Morgan et al.

(10) Patent No.: US 9,985,389 B1
(45) Date of Patent: May 29, 2018

(54) CONNECTOR ASSEMBLY HAVING A PIN ORGANIZER

(71) Applicant: TE CONNECTIVITY CORPORATION, Berwyn, PA (US)

(72) Inventors: Chad William Morgan, Carneys Point, NJ (US); John Joseph Consoli, Harrisburg, PA (US); Justin Dennis Pickel, Hummelstown, PA (US); David Allison Trout, Lancaster, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/482,078

(22) Filed: Apr. 7, 2017

(51) Int. Cl.

| | |
|---|---|
| ***H01R 13/64*** | (2006.01) |
| ***H01R 13/6471*** | (2011.01) |
| ***H01R 12/58*** | (2011.01) |
| ***H01R 13/6599*** | (2011.01) |
| ***H01R 13/6587*** | (2011.01) |

(52) U.S. Cl.
CPC ..... *H01R 13/6471* (2013.01); *H01R 12/585* (2013.01); *H01R 13/6587* (2013.01); *H01R 13/6599* (2013.01)

(58) Field of Classification Search
CPC ..... H01R 13/6471; H01R 13/6585; H01R 13/6586; H01R 13/6587; H01R 13/6588; H01R 13/6589
See application file for complete search history.

(56) References Cited

U.S. PATENT DOCUMENTS

| | | | | |
|---|---|---|---|---|
| 7,976,318 | B2 * | 7/2011 | Fedder | H01R 13/514 439/607.11 |
| 8,002,581 | B1 * | 8/2011 | Whiteman, Jr. | H01R 12/724 439/607.18 |
| 2014/0194004 | A1 * | 7/2014 | Pickel | H01R 13/648 439/607.01 |

* cited by examiner

*Primary Examiner* — Ross Gushi

(57) ABSTRACT

A connector assembly includes a housing and contact modules having signal contacts with signal pins and a ground shield providing electrical shielding for the signal contacts with ground pins. The connector assembly includes a conductive pin organizer coupled to the contact modules having a plurality of ground pin holes receiving ground pins and signal openings receiving signal pins. The conductive pin organizer substantially fills a space between the bottoms of the contact modules and the circuit board to provide electrical shielding for the signal pins between the bottoms of the contact modules and the circuit board.

18 Claims, 10 Drawing Sheets

CONNECTOR ASSEMBLY HAVING A PIN ORGANIZER

BACKGROUND OF THE INVENTION

The subject matter herein relates generally to connector assemblies having pin organizers.

Some electrical systems utilize connector assemblies, such as header assemblies and receptacle assemblies, to interconnect two circuit boards, such as a motherboard and daughtercard. The connector assemblies include contacts having pins extending from a mounting end of the connector assemblies. The pins are through-hole mounted to the circuit board by loading the pins into plated vias in the circuit board. The connector assemblies are typically pre-assembled and configured to be mounted to the circuit board. In order to insure that the pins are oriented correctly, many connector assemblies include pin organizers that are coupled to the bottoms of the connector assemblies and that hold the pins in proper positions for mounting to the circuit board.

High speed connector assemblies suffer from problems with cross talk and can exhibit higher than desirable return loss due to geometries of the signal and ground contacts. For example, gaps or spaces in shielding through the connector assembly can result in reduced connector performance. Conventional electrical systems that utilize pin organizers suffer from shielding problems in the area of the pin organizer. For example, the thickness of the pin organizer creates an unshielded area between the bottom of the connector assembly and the top of the circuit board.

A need remains for a connector assembly having improved electrical shielding.

BRIEF DESCRIPTION OF THE INVENTION

In one embodiment, a connector assembly is provided including a housing and a plurality of contact modules received in the housing. Each contact module has a plurality of signal contacts each including a signal pin for terminating to a circuit board. The signal pins extend from a bottom of the corresponding contact module. Each contact module has a ground shield providing electrical shielding for the signal contacts. The ground shield has a plurality of ground pins extending from a bottom of the ground shield for terminating to the circuit board. The connector assembly includes a conductive pin organizer coupled to the contact modules. The conductive pin organizer has a plurality of ground pin holes extending therethrough receiving corresponding ground pins. The conductive pin organizer has signal openings extending therethrough receiving corresponding signal pins. The signal openings are defined by side edges that are electrically isolated from the signal pins. The conductive pin organizer substantially fills a space between the bottoms of the contact modules and the circuit board to provide electrical shielding for the signal pins between the bottoms of the contact modules and the circuit board.

In a further embodiment, a connector assembly is provided including a housing and contact modules coupled to the housing. Each contact module includes a conductive holder holding a frame assembly including a plurality of signal contacts and a dielectric frame supporting the signal contacts. The dielectric frame is received in the conductive holder. The signal contacts each include a signal pin for terminating to a circuit board that extend from a bottom of the contact module. Each contact module includes a ground shield coupled to the conductive holder that is electrically connected to the conductive holder. The ground shield has ground pins extending beyond the bottom of the contact module for terminating to the circuit board. The connector assembly includes a conductive pin organizer coupled to the contact modules that is electrically connected to the conductive holders of the contact modules. The conductive pin organizer has a plurality of ground pin holes extending therethrough receiving corresponding ground pins. The conductive pin organizer has signal openings extending therethrough receiving corresponding signal pins. The signal openings are defined by side edges. The side edges are electrically isolated from the signal pins. The conductive pin organizer substantially fills a space between the bottoms of the contact modules and the circuit board to provide electrical shielding for the signal pins between the bottoms of the contact modules and the circuit board.

In another embodiment, a conductive pin organizer is provided for a connector assembly having a plurality of signal pins and a plurality of ground pins extending from a bottom of the connector assembly. The conductive pin organizer includes a plate having a top, a bottom, a front, a rear and opposite sides with edges extending between the top and bottom along the front, rear and sides. A plurality of ground pin holes extend through the plate between the top and bottom. The ground pin holes are configured to receive corresponding ground pins of the connector assembly. A plurality of signal openings extend through the plate between the top and bottom. The signal openings are configured to receive corresponding signal pins of the connector assembly. The plate is spaced apart from the signal pins as the signal pins pass through the plate to electrically isolate the plate from the signal pins.

DETAILED DESCRIPTION OF THE INVENTION

Figure 1:
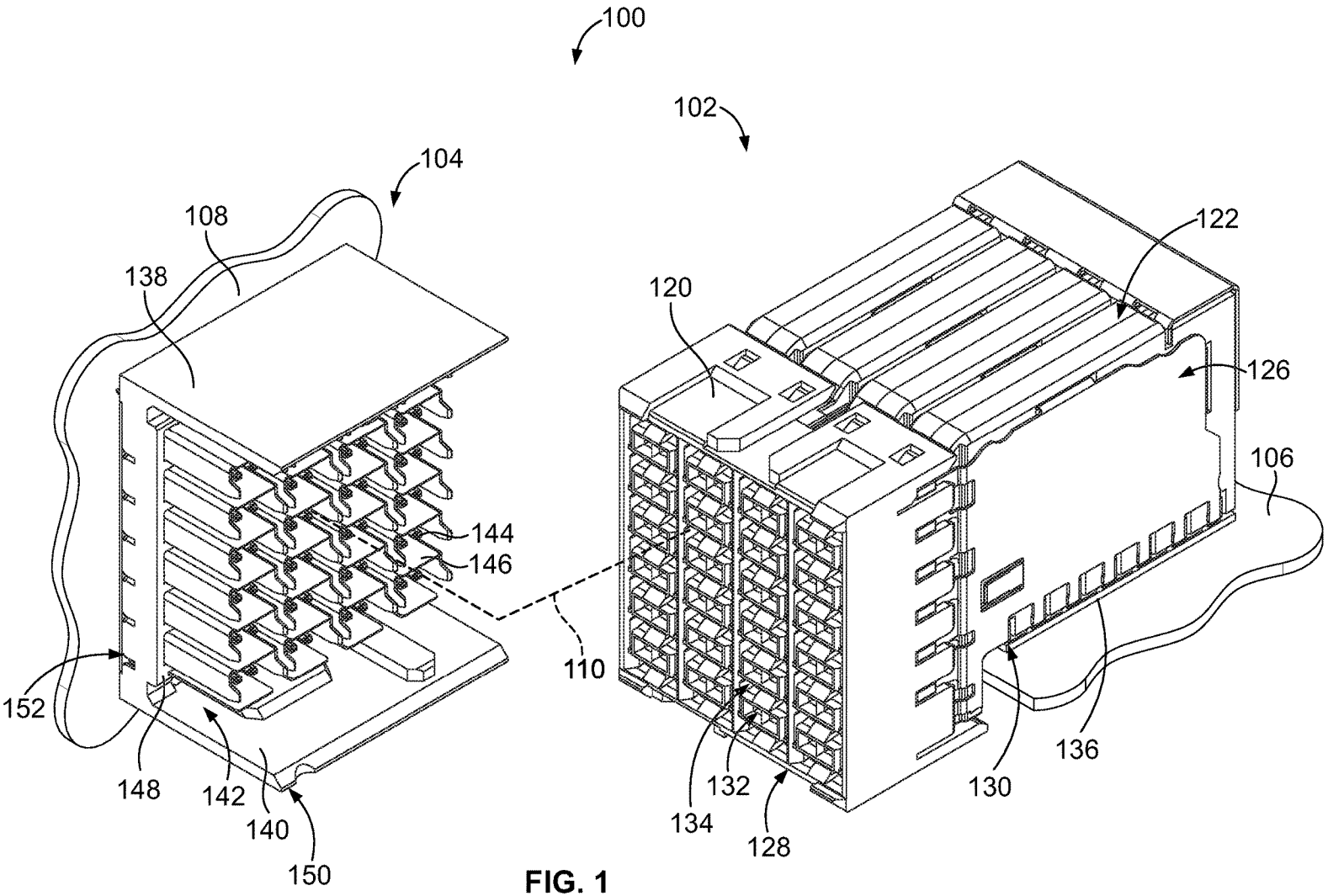
FIG. 1 is a perspective view of an electrical connector system formed in accordance with an exemplary embodiment.

FIG. 1 is a perspective view of an electrical connector system 100 formed in accordance with an exemplary embodiment. The connector system 100 includes first and second connector assemblies 102, 104. In the illustrated embodiment, the first connector assembly 102 is a receptacle assembly and may be referred to hereinafter as a receptacle assembly 102 and the second connector assembly 104 is a header assembly and may be referred to hereinafter as a header assembly 104. Other types of connector assemblies may be used in alternative embodiments, such as a vertical connector, a right angle connector or another type of connector. The subject matter described herein provides a conductive pin organizer for a connector assembly, such as the receptacle assembly 102, the header assembly 104 or other types of connector assemblies.

The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a housing 120 that holds a plurality of contact modules 122. The contact modules 122 are held in a stacked configuration generally parallel to one another. Any number of contact modules 122 may be provided in the receptacle assembly 102. The contact modules 122 each include a plurality of signal contacts 124 (shown in FIG. 2) that define signal paths through the receptacle assembly 102.

The receptacle assembly 102 includes a front 128 defining a mating end (which may be referred to hereinafter as mating end 128) and a bottom 130 defining a mounting end (which may be referred to hereinafter as mounting end 130). The mating and mounting ends may be at different locations other than the front 128 and bottom 130 in alternative embodiments. The signal contacts 124 (shown in FIG. 2) are received in the housing 120 and held therein at the mating end 128 for electrical termination to the header assembly 104. The signal contacts 124 are arranged in a matrix of rows and columns. In the illustrated embodiment, at the mating end 128, the rows are oriented horizontally and the columns are oriented vertically. The signal contacts 124 within each column are provided within a respective same contact module 122. The signal contacts 124 within each row are provided in multiple contact modules 122. Other orientations are possible in alternative embodiments. Any number of signal contacts 124 may be provided in the rows and columns. The signal contacts 124 extend through the receptacle assembly 102 from the mating end 128 to the mounting end 130 for mounting to the circuit board 106. Optionally, the mounting end 130 may be oriented substantially perpendicular to the mating end 128.

Optionally, the signal contacts 124 may be arranged in pairs carrying differential signals. In the illustrated embodiment, the pairs of signal contacts 124 are arranged in the same row (pair-in-row arrangement); however, in alternative embodiments, the pairs of signal contacts 124 may be arranged in the same column (pair-in-column arrangement).

In an exemplary embodiment, each contact module 122 has a shield structure 126 for providing electrical shielding for the signal contacts 124. The contact modules 122 may generally provide 360° shielding for each pair of signal contacts 124 along substantially the entire length of the signal contacts 124 between the mounting end 130 and the mating end 128. In an exemplary embodiment, the shield structure 126 is electrically connected to the header assembly 104 and/or the circuit board 106. For example, the shield structure 126 may be electrically connected to the header assembly 104 by extensions (for example beams and/or fingers) extending from the contact modules 122 that engage the header assembly 104. The shield structure 126 may be electrically connected to the circuit board 106 by features, such as ground pins. In an exemplary embodiment, a portion of the shield structure 126 on one side of the contact module 122 is electrically connected to a portion of the shield structure 126 on another side of the contact module 122. For example, portions of the shield structure 126 on opposite sides of the contact module 122 may be electrically connected to each other by internal extensions (for example tabs) that extend through the interior of the contact module 122. Having the portions of the shield structure 126 on opposite sides of the contact module 122 electrically connected to each other electrically commons the portions of the shield structure 126 to provide increased performance of the signal transmission through the contact module 122. In an exemplary embodiment, a conductive pin organizer 136 is provided forming part of the shield structure 126. The conductive pin organizer 136 may be electrically connected to other portions of the shield structure 126. The conductive pin organizer 136 provides electrical shielding at the bottom 130 of the receptacle assembly 102. For example, the conductive pin organizer 136 provides electrical shielding below the contact modules 122, such as between the contact modules 122 and the circuit board 106.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding header signal contacts 144 therein when the receptacle and header assemblies 102, 104 are mated. The ground contact openings 134 receive header ground contacts 146 therein when the receptacle and header assemblies 102, 104 are mated. The ground contact openings 134 also receive the extensions (for example beams and/or fingers) of the shield structure 126 of the contact modules 122 that mate with the header ground contacts 146 to electrically common the receptacle and header assemblies 102, 104.

The housing 120 is manufactured from a dielectric material, such as a plastic material, and provides isolation between the signal contact openings 132 and the ground contact openings 134. The housing 120 isolates the signal contacts 124 and the header signal contacts 144 from the header ground contacts 146. The housing 120 isolates each set of receptacle and header signal contacts 124, 144 from other sets of receptacle and header signal contacts 124, 144.

The receptacle assembly 102 includes the conductive pin organizer 136 coupled to the bottom 130 of the receptacle assembly 102. The conductive pin organizer 136 is used to hold the relative positions of the signal and ground pins for mounting to the circuit board 106. The conductive pin organizer 136 includes holes or openings spaced apart in an array corresponding to a particular pinout of vias in the circuit board 106 to which the receptacle assembly 102 is mounted. The conductive pin organizer 136 is captured between the bottom 130 of the receptacle assembly 102 and the circuit board 106 when the receptacle assembly 102 is mounted to the circuit board 106. The conductive pin organizer 136 substantially fills the space between the bottoms of the contact modules 122 and the circuit board 106 to provide electrical shielding for the signal contacts 124 between the bottoms of the contact modules 122 and the circuit board 106. In an exemplary embodiment, the conductive pin organizer 136 is manufactured form a conductive material, such as a metal material or a metalized plastic material to provide electrical shielding in the transition or mating zone of the receptacle assembly 102 with the circuit board 106.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. A conductive pin organizer similar to the conductive pin organizer 136 may be provided between the mounting end 152 and the circuit board 108. The receptacle assembly 102 is configured to be received in the chamber 142 through the mating end 150. The housing 120 engages the walls 140 to hold the receptacle assembly 102 in the chamber 142. The header signal contacts 144 and the header ground contacts 146 extend from a base wall 148 into the chamber 142 for mating with the receptacle assembly 102.

The header ground contacts 146 provide electrical shielding around corresponding header signal contacts 144. The header signal contacts 144 may be arranged in rows and columns on the header assembly 104. In an exemplary embodiment, the header signal contacts 144 are arranged in pairs configured to convey differential signals. The header ground contacts 146 peripherally surround a corresponding pair of the header signal contacts 144 to provide electrical shielding. In the illustrated embodiment, the header ground contacts 146 are C-shaped, covering three sides of the pair of header signal contacts 144.

Figure 2:
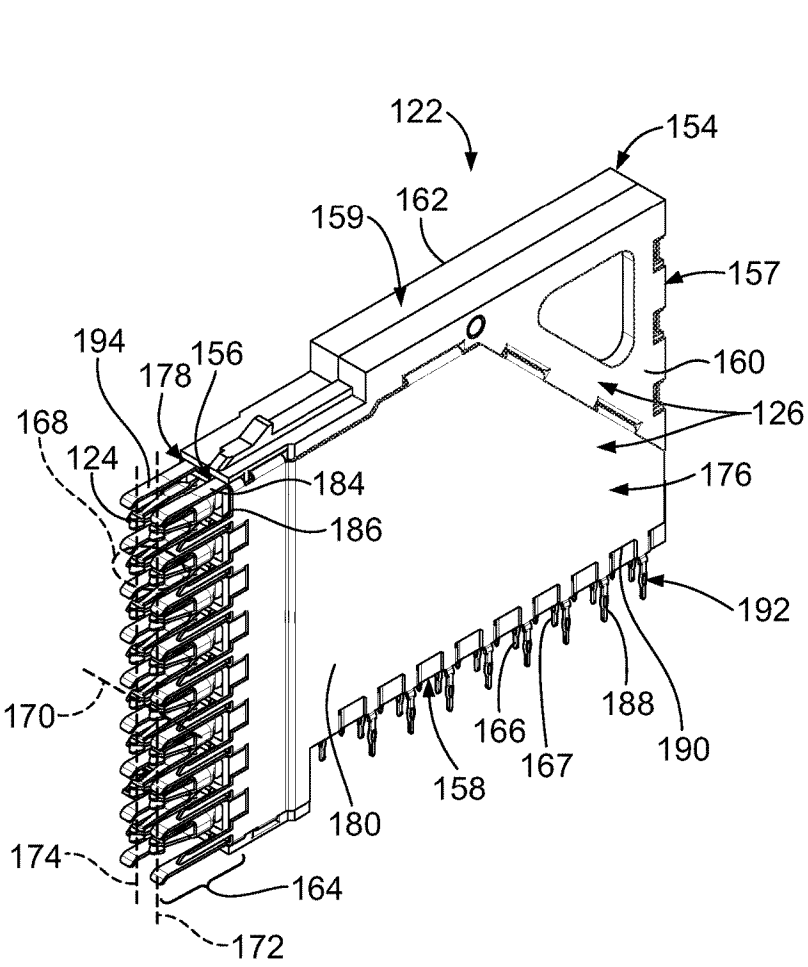
FIG. 2 is an exploded view of a receptacle assembly of the electrical connector system showing a contact module.
Figure 2:
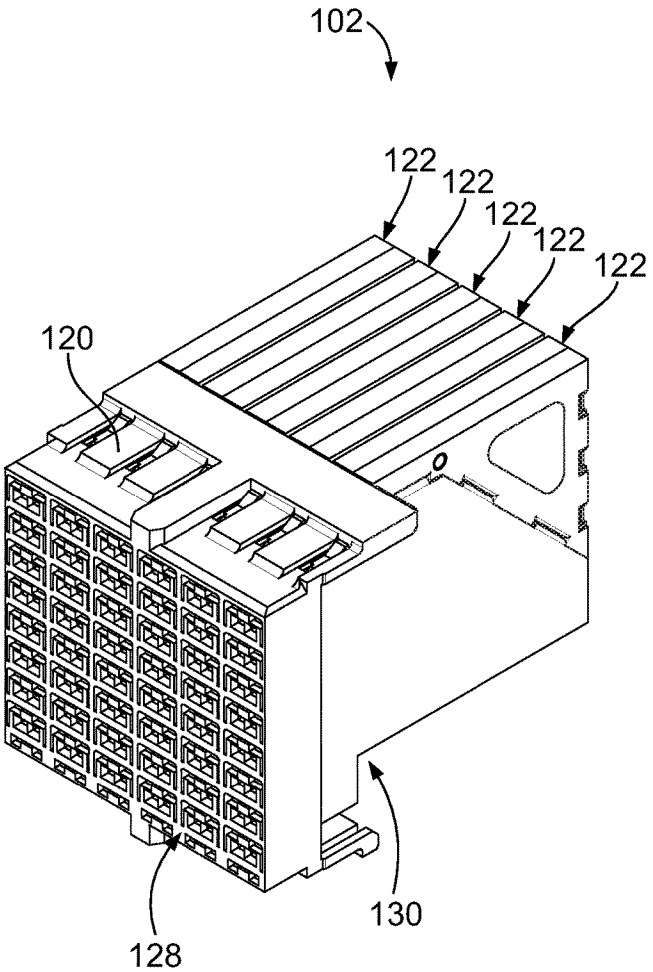
Figure 3:
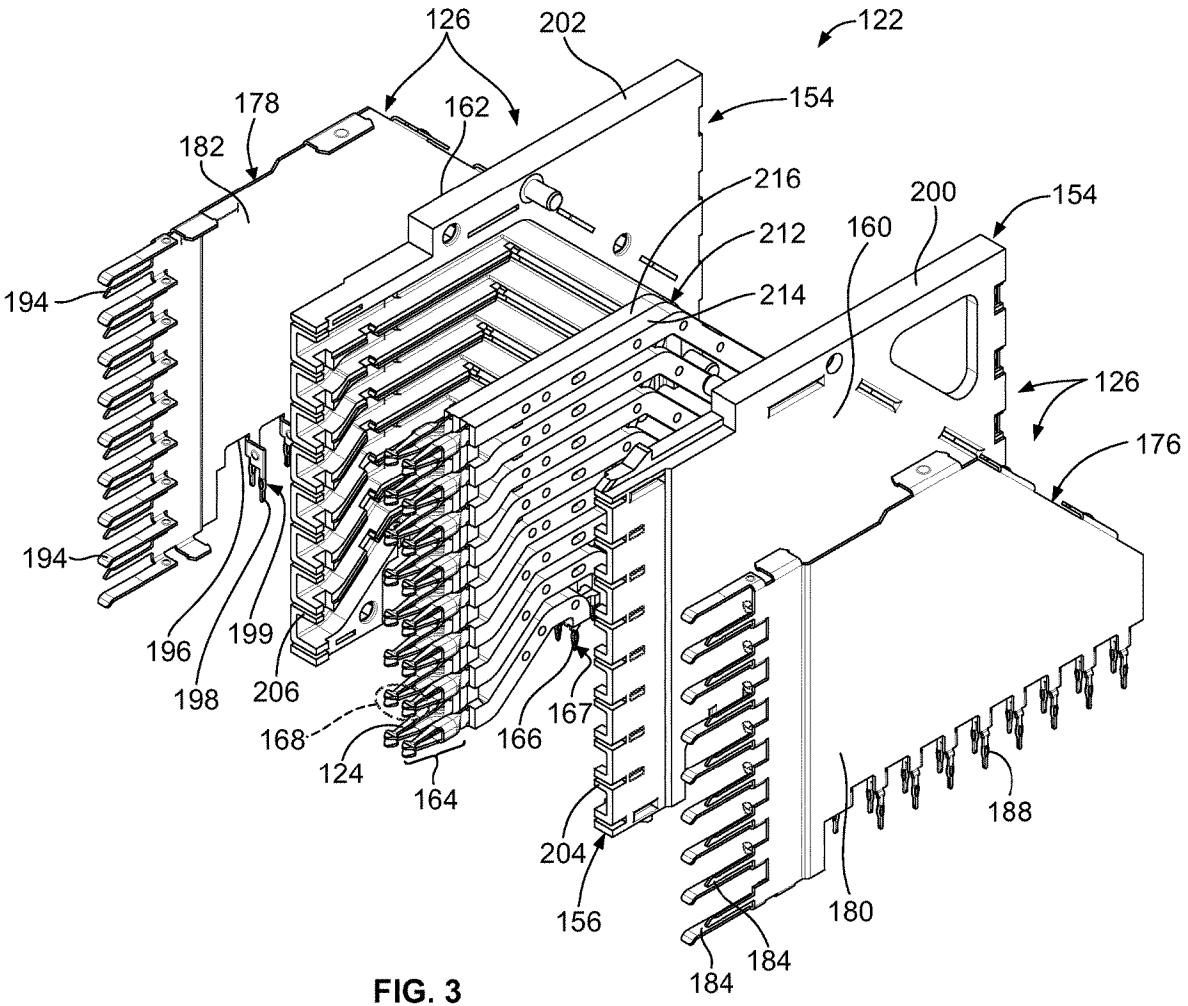
FIG. 3 is an exploded perspective view of the contact module.

FIG. 2 is an exploded view of the receptacle assembly 102 showing one of the contact modules 122 poised for loading into the housing 120. FIG. 3 is an exploded perspective view of the contact module 122. The contact modules 122 may be loaded side-by-side and parallel to each other in a stacked configuration. Six contact modules 122 are illustrated in FIG. 2, but any number of contact modules 122 may be used in alternative embodiments.

In an exemplary embodiment, the contact module 122 includes a conductive holder 154 which defines at least a portion of the shield structure 126. The conductive holder 154 generally surrounds the signal contacts 124 along substantially the entire length of the signal contacts 124 between the mounting end 130 and the mating end 128. The conductive holder 154 has a front 156 configured to be loaded into the housing 120, a rear 157 opposite the front 156, a bottom 158 that faces the circuit board 106 and the conductive pin organizer 136 (both shown in FIG. 1), and a top 159 generally opposite the bottom 158. The bottom 158 of the conductive holder 154 may define a bottom of the contact module 122. The bottom 158 of the conductive holder 154 may define the bottom 130 of the receptacle assembly 102. The conductive holder 154 also defines right and left exterior sides 160, 162, as viewed from the front.

The conductive holder 154 is fabricated from a conductive material which provides electrical shielding for the receptacle assembly 102. For example, the conductive holder 154 may be die-cast, or alternatively stamped and formed, from a metal material. In other alternative embodiments, the holder 154 may be fabricated from a plastic material that has been metalized or coated with a metallic layer. In other embodiments, rather than a conductive holder, the holder 154 may be non-conductive. In other embodiments, the contact module 122 may be provided without the conductive holder 154 altogether.

The signal contacts 124 have mating portions 164 extending forward from the front 156 of the conductive holder 154. The mating portions 164 are configured to be electrically terminated to corresponding header signal contacts 144 (shown in FIG. 1) when the receptacle assembly 102 and header assembly 104 (shown in FIG. 1) are mated. In an exemplary embodiment, the other ends of the signal contacts 124 extend downward from the bottom 158 of the conductive holder 154 as signal pins 166 or simply pins 166. The signal pins 166 electrically connect the contact module 122 to the circuit board 106 (shown in FIG. 1). The signal pins 166 are configured to be terminated to the circuit board 106. For example, the signal pins 166 may be through-hole mounted to the circuit board 106. The signal pins 166 may be compliant pins, such as eye-of-the-needle pins. For example, the signal pins 166 have enlarged areas 167 that are configured to engage corresponding plated vias of the circuit board 106 by an interference fit to mechanically and electrically couple the signal pins 166 to the circuit board 106. Optionally, in some embodiments, rather than being signal pins, at least some of the pins 166 may be ground pins that are part of ground contacts forming part of the shield structure 126. In the illustrated embodiment, the mating portions 164 extend generally perpendicular with respect to the signal pins 166; however, other orientations are possible in alternative embodiments.

In an exemplary embodiment, the signal contacts 124 in each contact module 122 are arranged as contact pairs 168 configured to transmit differential signals through the contact module 122. The signal contacts 124 within each contact pair 168 are arranged in rows that extend along row axes 170. In an exemplary embodiment, each row axis 170 includes one contact pair 168 from each contact module 122 stacked together in the receptacle assembly 102. At the mating end 128, the contact pairs 168 within each contact module 122 are stacked vertically. The right signal contacts 124 of each contact module 122 extend along a column axis 172, and the left signal contacts 124 of each contact module extend along a column axis 174. When the contact modules 122 are stacked in the receptacle assembly 102, the column axes 172, 174 of the contact modules 122 extend parallel to each other. In other embodiments, the contact pairs 168 may be arranged in-column rather than in-row.

In an exemplary embodiment, each contact module 122 includes first and second ground shields 176, 178, which define at least a portion of the shield structure 126. The ground shields 176, 178 may be positioned along the exterior sides 160, 162 of the conductive holder 154. For example, the first ground shield 176 may be positioned along the right side 160 of the conductive holder 154, and as such, may be hereinafter referred to as the right ground shield 176. The second ground shield 178 (FIG. 3) may be positioned along the left side 162 of the conductive holder, and may be hereinafter referred to as the left ground shield 178. The ground shields 176, 178 are configured to provide electrical shielding for the signal contacts 124. The ground shields 176, 178 electrically connect the contact module 122 to the header ground contacts 146 (shown in FIG. 1), thereby electrically commoning the connection across the receptacle assembly 102 and header assembly 104 (shown in FIG. 1). Optionally, a single ground shield may be used rather than two ground shields. Alternatively, the contact module 122 may not include any ground shields.

The right ground shield 176 is coupled to the right exterior side 160 of the conductive holder 154. When attached to the conductive holder 154, the right ground shield 176 electrically connects to the conductive holder 154. The right ground shield 176 includes a main body 180 that is generally planar and extends alongside of the conductive holder 154. The ground shield 176 includes grounding beams 184 extending from a front 186 of the main body 180. The ground shield 176 includes ground pins 188 extending from a bottom 190 of the main body 180. In an exemplary embodiment, the ground pins 188 are configured to be electrically connected to the conductive pin organizer 136 (shown in FIG. 1). The ground pins 188 are configured to be terminated to the circuit board 106 (shown in FIG. 1). For example, the ground pins 188 may be through-hole mounted to the circuit board 106. The ground pins 188 may be compliant pins, such as eye-of-the-needle pins. The ground pins 188 have enlarged areas 192 that are configured to engage corresponding plated vias of the circuit board 106 by an interference fit to mechanically and electrically couple the ground pins 188 to the circuit board 106.

The left ground shield 178 (FIG. 3) may be similar to the right ground shield 176. The left ground shield 178 may be a mirrored version of the right ground shield 176. The left ground shield 178 is coupled to the left exterior side 162 of the conductive holder 154. The left ground shield 178 includes a main body 182 that is generally planar and extends alongside of the conductive holder 154. The ground shield 178 includes grounding beams 194 extending from a front of the main body 182. The ground shield 178 includes ground pins 198 extending from a bottom 196 of the main body 182. In an exemplary embodiment, the ground pins 198 are configured to be electrically connected to the conductive pin organizer 136. The ground pins 198 are configured to be terminated to the circuit board 106 (shown in FIG. 1). For example, the ground pins 198 may be through-hole mounted to the circuit board 106. The ground pins 198 may be compliant pins, such as eye-of-the-needle pins. The ground pins 198 have enlarged areas 199 that are configured to engage corresponding plated vias of the circuit board 106 by an interference fit to mechanically and electrically couple the ground pins 198 to the circuit board 106.

In an exemplary embodiment, the right and left ground shields 176, 178 are manufactured from a metal material. The ground shields 176, 178 are stamped and formed parts with the grounding beams 184, 194 being stamped and then formed during a forming process. The ground pins 188, 198 are stamped and/or formed.

The conductive holder 154 shown in the illustrated embodiment includes a right holder member 200 and a left holder member 202. Upon assembling the contact module 122, the right and left holder members 200, 202 are coupled together to form the conductive holder 154. The right and left ground shields 176, 178 are coupled to the right and left holder members 200, 202, respectively. The right ground shield 176 engages and is electrically connected to the right holder member 200. The left ground shield 178 (FIG. 3) engages and is electrically connected to the left holder member 202. In various embodiments, the ground shields 176, 178 and/or the holder members 200, 202 may be electrically connected to the conductive pin organizer 136.

As a part of the shield structure 126, the holder members 200, 202 generally provide electrical shielding between and around respective signal contacts 124. For example, the holder members 200, 202 provide shielding from electromagnetic interference (EMI) and/or radio frequency interference (RFI), and may provide shielding from other types of interference as well. The holder members 200, 202 may provide shielding around the outside of the signal contacts 124 as well as between the signal contacts 124 using tabs 204, 206. As a result, the holder members 200, 202 allow for better control of electrical characteristics, such as impedance, cross-talk, and the like, of the signal contacts 124.

The conductive holder 154 holds a frame assembly 212, which includes the signal contacts 124. Upon assembly of the contact module 122, the frame assembly 212 is received in the right and left holder members 200, 202. The holder members 200, 202 provide shielding around the frame assembly 212 and signal contacts 124. The tabs 204, 206 are configured to extend into the frame assembly 212 such that the tabs 204, 206 are positioned between signal contact pairs 168 to provide shielding between adjacent contact pairs 168.

The frame assembly 212 includes a pair of right and left dielectric frames 214, 216, respectively, surrounding and supporting the signal contacts 124. In an exemplary embodiment, one of the signal contacts 124 of each contact pair 168 is held by the right dielectric frame 214, while the other signal contact 124 of the contact pair 168 is held by the left dielectric frame 216. The signal contacts 124 of each contact pair 168 extend through the frame assembly 212 generally along parallel paths such that the signal contacts 124 are skewless between the mating portions 164 and the signal pins 166.

In an exemplary embodiment, the signal contacts 124 are initially held together as leadframes (not shown), which are overmolded with dielectric material to form the dielectric frames 214, 216. Manufacturing processes other than overmolding a leadframe may be utilized to form the dielectric frames 214, 216, such as loading signal contacts 124 into a formed dielectric body. In various alternative embodiments, the ground shields 176 and/or 178 may be coupled directly to the dielectric frames 214, 216 without the need for the conductive holder 154.

Figure 4:
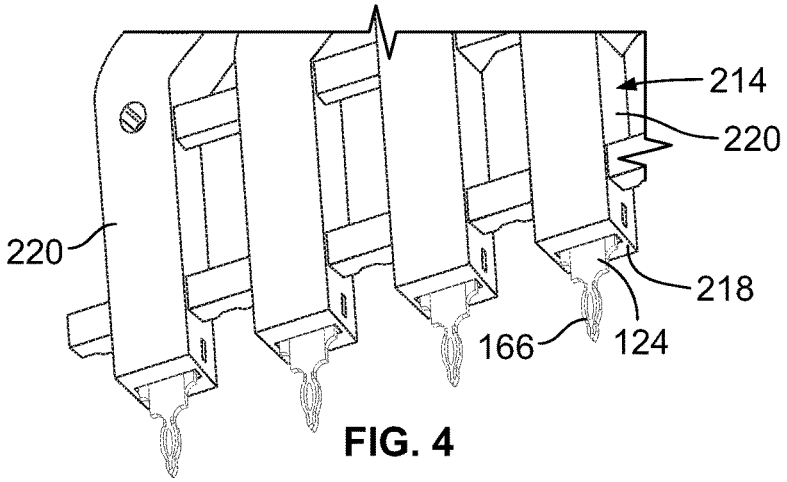
FIG. 4 is a bottom perspective view of a portion of a dielectric frame of the contact module in accordance with an exemplary embodiment.
Figure 5:
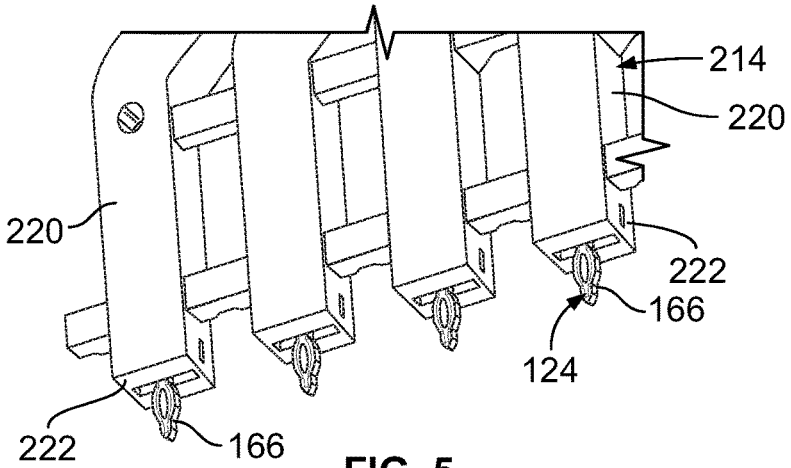
FIG. 5 is another bottom perspective view of a portion of the dielectric frame in accordance with an exemplary embodiment.

FIG. 4 is a bottom perspective view of a portion of the dielectric frame 214 in accordance with an exemplary embodiment. FIG. 5 is another bottom perspective view of a portion of the dielectric frame 214 in accordance with an exemplary embodiment. FIGS. 4 and 5 show the signal pins 166 extending from the dielectric frame 214. The dielectric frame 214 includes frame members 220 that encase the signal contacts 124 along the transition portions of the signal contacts 124 between the signal pins 166 and the mating portions 164 (shown in FIG. 3). The signal pins 166 extend beyond bottoms 218 of the frame members 220 for termination to the circuit board 106 (shown in FIG. 1).

FIG. 5 illustrates the dielectric frame 214 with signal pin spacers 222 extending along portions of the signal pins 166. The signal pin spacers 222 of the embodiment illustrated in FIG. 5 are extensions of the frame members 220 to cover more of the signal contacts 124 as compared to the embodiment illustrated in FIG. 4 that does not include the signal pin spacers 222. The signal pin spacers 222 provide support for the signal pins 166. In an exemplary embodiment, the signal pin spacers 222 are configured to be received in the conductive pin organizer 136 (shown in FIG. 1) to provide electrical isolation for the signal pins 166 from the conductive pin organizer 136. Optionally, the signal pin spacers 222 may extend below the bottom of the conductive holder 154 (shown in FIG. 3).

Figure 6:
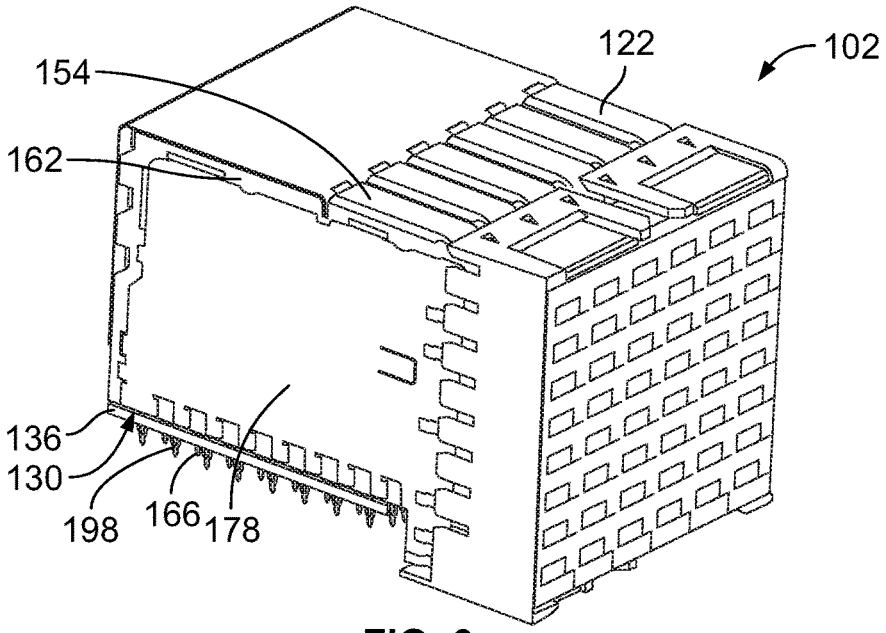
FIG. 6 is a perspective view of the receptacle assembly in accordance with an exemplary embodiment showing a conductive pin organizer coupled to a bottom of the receptacle assembly.

FIG. 6 is a perspective view of the receptacle assembly 102 in accordance with an exemplary embodiment showing the conductive pin organizer 136 coupled to the bottom 130 of the receptacle assembly 102. The left ground shield 178 is coupled to the left exterior side 162 of the conductive holder 154. The conductive pin organizer 136 is positioned below the contact modules 122. The signal pins 166 and ground pins 198 pass through the conductive pin organizer 136 for termination to the circuit board 106 (shown in FIG. 1). The ground shield 178 may be electrically connected to the conductive pin organizer 136. The conductive holder 154 may be electrically connected to the conductive pin organizer 136.

Figure 7:
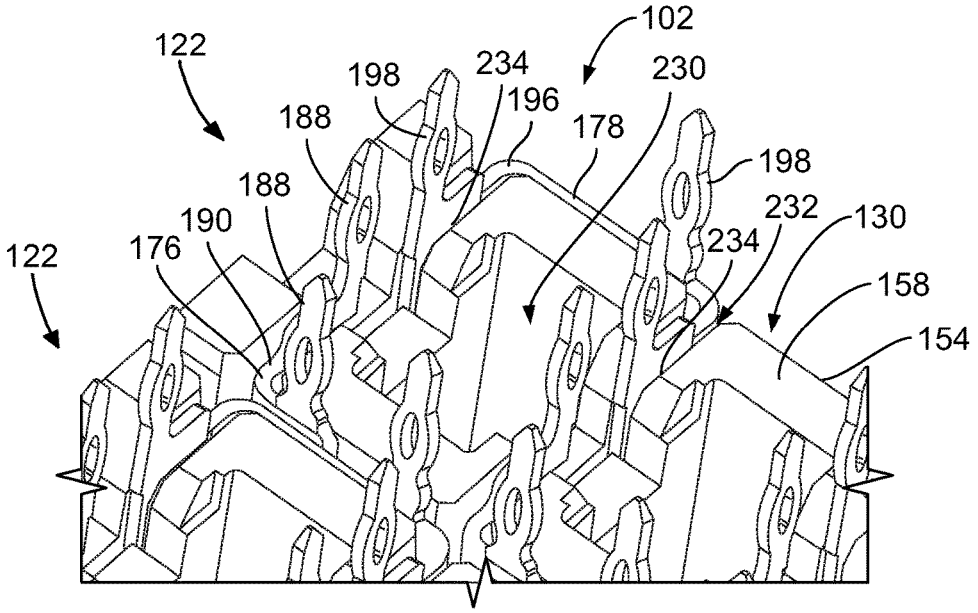
FIG. 7 is a perspective view of the bottom of a portion of the receptacle assembly.

FIG. 7 is a perspective view of the bottom 130 of a portion of the receptacle assembly 102. FIG. 7 shows the conductive holders 154 and the ground shields 176, 178 of some of the contact modules 122 of the receptacle assembly 102. The frame assemblies 212 and the signal contacts 124 (both shown in FIG. 3) are removed for clarity to illustrate the conductive holders 154 and the ground shields 176, 178. The conductive holders 154 define tubes 230 that receive corresponding frame members 220 (shown in FIG. 4). The conductive holders 154 provide electrical shielding for the tubes 230, and thus for the signal contacts 124 routed in the tubes 230. The conductive holders 154 may include cutouts or pockets that receive portions of the frame assemblies 212 for positioning the frame assemblies 212 relative to the conductive holders 154.

The ground shields 176, 178 are oriented around the tubes 230 to provide electrical shielding. The ground pins 188, 198 extend below the bottoms 158 of the conductive holders 154. The ground shields 176, 178 may extend into slots 232 formed in the conductive holders 154, such as for positioning corresponding ground pins 188, 198 in line with the signal contacts 124. In an exemplary embodiment, the ground shields 176, 178 may include protrusions 234, such as bumps, that interfere with the conductive holders 154 to ensure an electrical connection between the ground shields 176, 178 and the conductive holders 154.

In an exemplary embodiment, the conductive pin organizer 136 (shown in FIG. 8) is configured to engage the conductive holders 154 and/or the ground shields 176, 178 to electrically connect to the conductive holders 154 and/or the ground shields 176, 178. For example, the conductive pin organizer 136 may be configured to seat against the bottoms 158 of the conductive holders 154. The conductive pin organizer 136 may be configured to seat against the bottoms 190, 196 of the ground shields 176, 178.

Figure 8:
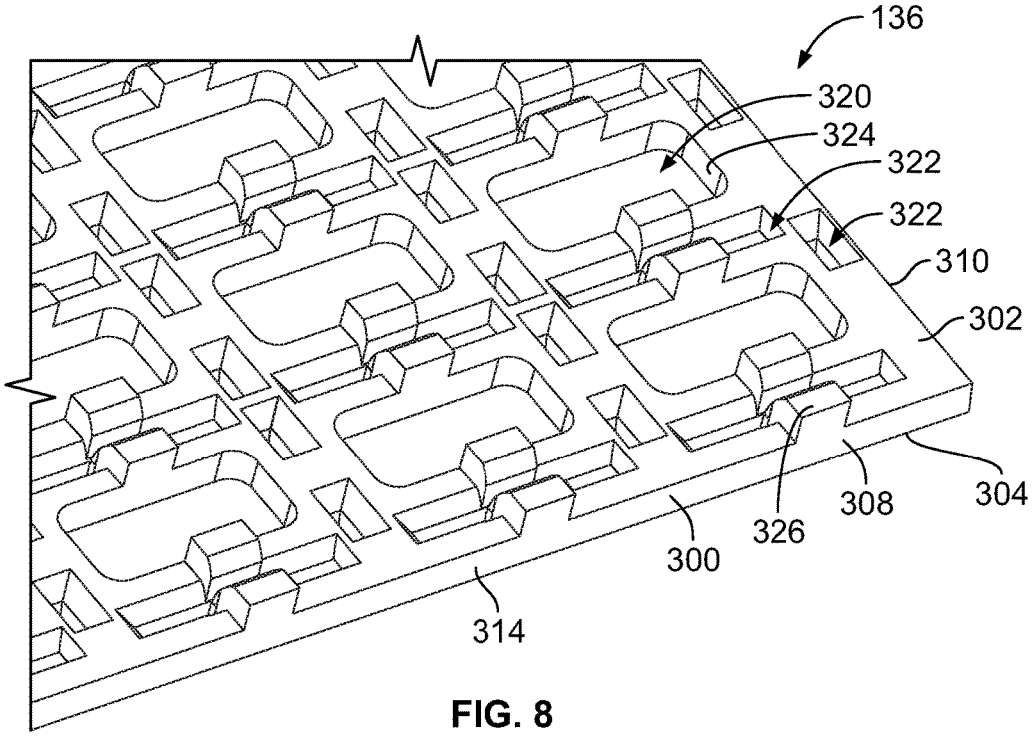
FIG. 8 is a top perspective view of the conductive pin organizer formed in accordance with an exemplary embodiment.
Figure 9:
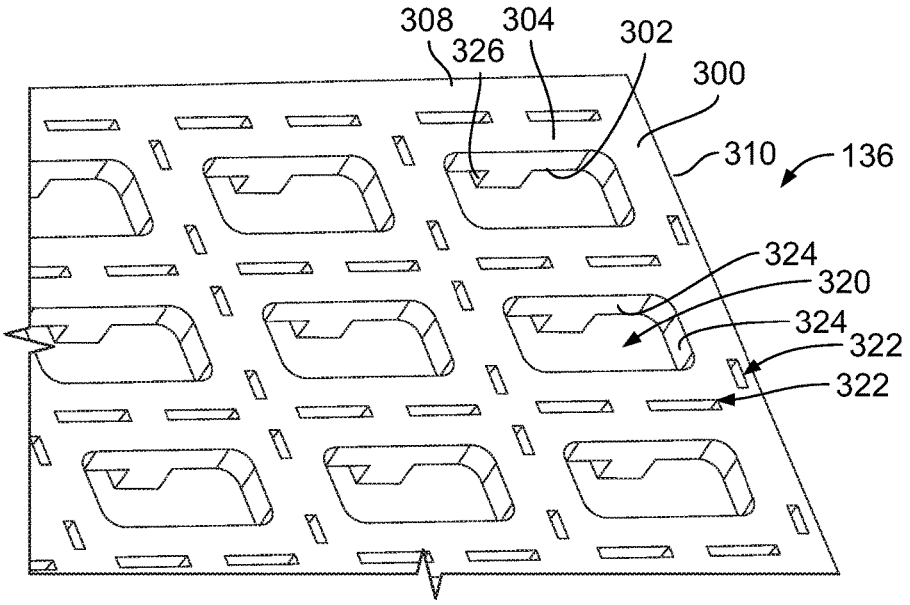
FIG. 9 is a bottom perspective view of the conductive pin organizer.
Figure 10:
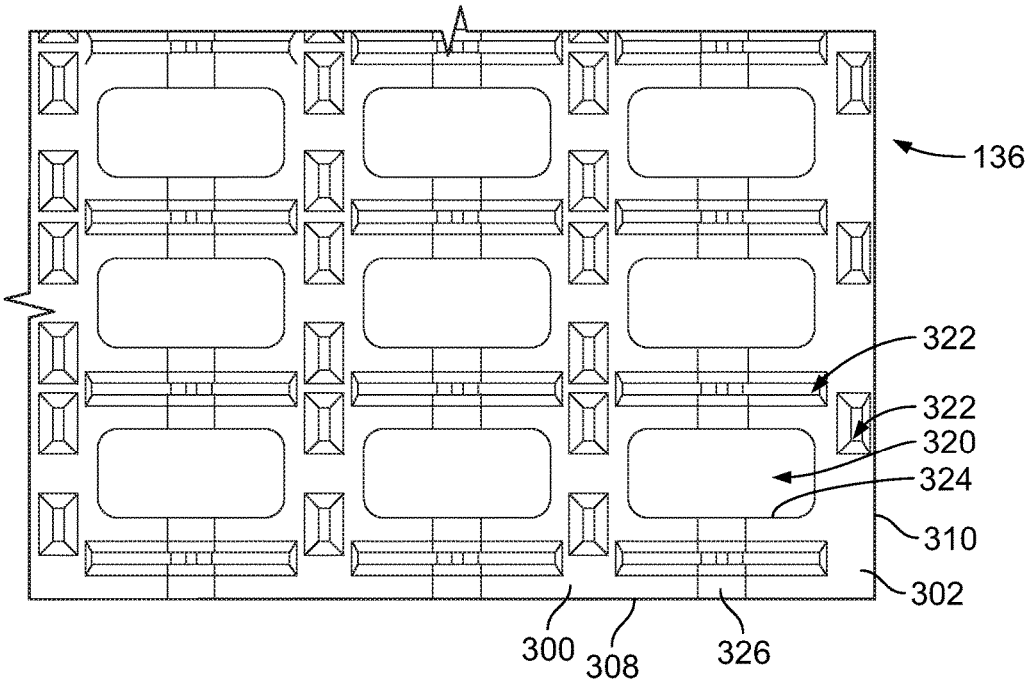
FIG. 10 is a top view of the conductive pin organizer.

FIG. 8 is a top perspective view of the conductive pin organizer 136 formed in accordance with an exemplary embodiment. FIG. 9 is a bottom perspective view of the conductive pin organizer 136. FIG. 10 is a top view of the conductive pin organizer 136. The conductive pin organizer 136 includes a base or plate 300 having a top 302, bottom 304, front (not shown), rear 308 and opposite sides 310. The conductive pin organizer 136 includes edges 314 extending between the top 302 and the bottom 304 along the front, rear 308 and sides 310. The top 302 is configured to engage the bottoms 158 of the contact modules 122 (both shown in FIG. 2) to locate the conductive pin organizer 136 relative to the contact modules 122.

The conductive pin organizer 136 is conductive to provide electrical shielding for the signal pins 166 (shown in FIG. 2) passing through the conductive pin organizer 136. For example, the conductive pin organizer 136 may be fabricated from a plastic material that has been metalized or coated with a metallic layer. In alternative embodiments, the conductive pin organizer 136 may be die-cast, or alternatively stamped and formed, from a metal material. In an exemplary embodiment, the conductive pin organizer 136 is conductive through the plate 300 to provide electrical shielding at the top 302, at the bottom 304 and therebetween.

The conductive pin organizer 136 includes a plurality of signal openings 320 and ground pin holes 322 extending through the plate 300 between the top 302 and bottom 304. The signal openings 320 receive corresponding signal pins 166 and the ground pin holes 322 receive corresponding ground pins 188, 198 (shown in FIG. 2) of the receptacle assembly 102 (shown in FIG. 2). The ground pin holes 322 are spaced apart in an array corresponding to a particular pinout of vias (not shown) in the circuit board 106 (shown in FIG. 1) to which the receptacle assembly 102 is mounted. The conductive pin organizer 136 may hold the positions of the ground pins 188, 198 for mounting to the circuit board 106. The ground pins 188, 198 are configured to extend through the plate 300 beyond the bottom 304 of the conductive pin organizer 136. In the illustrated embodiment, the ground pin holes 322 are positioned between columns of the signal openings 320 and between rows of the signal openings 320 to accommodate the arrangement of the ground pins 188, 198, which are located around each of the pairs of signal pins 166. For example, the ground pin holes 322 are arranged between adjacent signal openings 320 that are in the same column and the ground pin holes 322 are arranged between adjacent signal openings 320 that are in the same row. In an exemplary embodiment, the ground pin holes 322 have chamfered lead-ins at the top 302 for loading the ground pins 188, 198 into the ground pin holes 322.

In an exemplary embodiment, the signal openings 320 are oversized relative to the ground pin holes 322. For example, the signal openings 320 are designed to accommodate more than one signal pin 166, such as a corresponding pair of the signal pins 166. Furthermore, the signal openings 320 are oversized relative to the corresponding signal pins 166 to ensure that the conductive pin organizer 136 remains spaced apart from the signal pins 166 to avoid short circuiting and to control signal integrity of the signals. For example, the signal openings 320 are defined by side edges 324. The side edges 324 are configured to be electrically isolated from the signal pins 166. Optionally, the signal openings 320 may have chamfered lead-ins at the top 302. Optionally, the conductive pin organizer 136 may include locating features 326 extending from the top 302. The locating features 326 may engage the contact modules 122, such as the conductive holders 154.

Figure 11:
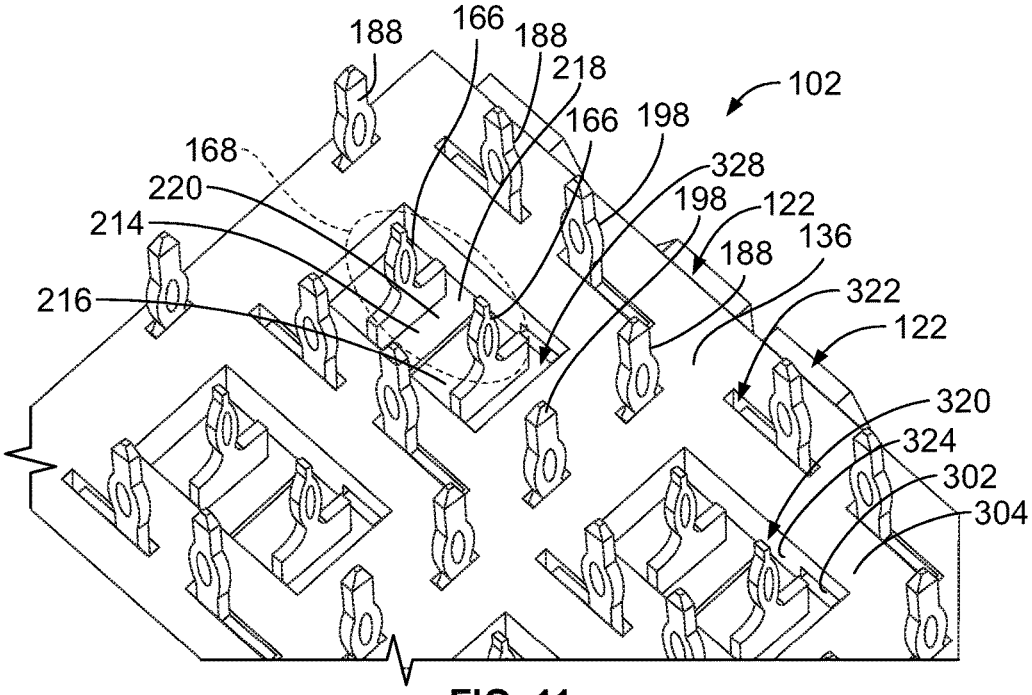
FIG. 11 is a bottom perspective view of a portion of the receptacle assembly showing the conductive pin organizer coupled to the contact modules.

FIG. 11 is a bottom perspective view of a portion of the receptacle assembly 102, showing the conductive pin organizer 136 coupled to the contact modules 122. In the embodiment shown in FIG. 11, the contact modules 122 do not include the signal pin spacers 222 (FIG. 5). The conductive pin organizer 136 is loaded onto the bottom of the receptacle assembly 102 such that the signal pins 166 are received in corresponding signal openings 320 and the ground pins 188, 198 are received in corresponding ground pin holes 322. The signal pins 166 and the ground pins 188, 198 pass through the conductive pin organizer 136 and are exposed below the bottom 304 for mounting to the circuit board 106 (shown in FIG. 1). The conductive pin organizer 136 is configured to substantially fill a space between the bottoms 158 of the contact modules 122 and the circuit board 106 to provide electrical shielding for the signal pins 166 between the bottoms 158 of the contact modules 122 and the circuit board 106.

In an exemplary embodiment, the conductive pin organizer 136 is initially loaded onto the pins 166, 188, 198 to an intermediate position, such as for shipping. The conductive pin organizer 136 protects the pins 166, 188, 198 in the intermediate position. When mating to the circuit board 106, the conductive pin organizer 136 is moved from the intermediate position to a fully loaded position where the conductive pin organizer 136 abuts against the bottoms 158 of the contact modules 122. The conductive pin organizer 136 may be moved, for example pushed, to the fully loaded position as the receptacle assembly 102 is mounted to the circuit board 106. For example, as the pins 166, 188, 198 are loaded into the plated vias of the circuit board 106, the conductive pin organizer 136 is eventually pushed against the circuit board 106 and further pushing of the receptacle assembly 102 in the loading direction pushes the conductive pin organizer 136 to the fully loaded position (for example, upward on the pins 166, 188, 198).

The ground pin holes 322 are sized to receive the corresponding ground pins 188, 198. Optionally, the ground pins 188, 198 are received in the ground pin holes 322 by an interference fit. For example, at least a portion of the ground pins 188, 198 engage the conductive pin organizer 136 to create an electrical connection between the ground pins 188, 198 and the conductive pin organizer 136. In the illustrated embodiment, the ground pins 188, 198 surround each contact pair 168 of signal pins 166. For example, the ground pins 188, 198 are located in-column with the signal pins 166 and are located in-row with the signal pins 166 to provide electrical shielding between adjacent contact pairs 168 of the signal pins 166. The conductive pin organizer 136 separates the pairs 168 of signal pins 166 from each other and provides electrical shielding in the space between the pairs 168 of signal pins 166.

In the illustrated embodiment, each signal opening 320 receives the corresponding contact pair 168 of the signal pins 166. The side edges 324 defining the signal opening 320 surround the signal pins 166. For example, the side edges 324 may form a box around the signal pins 166. The signal openings 320 may have other shapes in alternative embodiments. The side openings 320 are oversized relative to the signal pins 166 to ensure that the conductive pin organizer 136 does not engage any of the signal pins 166. For example, the side edges 324 are spaced apart from the signal pins 166 defining gaps 328 around the signal pins 166 to electrically isolate the signal pins 166 from the conductive pin organizer 136. The side edges 324 are conductive and provide electrical shielding around the signal pins 166.

In the illustrated embodiment, the signal pins 166 extend from the dielectric frames 214, 216 into the conductive pin organizer 136. For example, the bottoms 218 of the frame members 220 are generally flush with the top 302 of the conductive pin organizer 136 such that the frame members 220 do not extend into the signal openings 320. The signal pins 166 extending beyond the bottoms 218 of the frame members 220 are surrounded by air within the signal openings 320. The distance between the side edges 324 and the signal pins 166 are selected to control the signal integrity and electrical performance of the signals passing through the signal pins 166. For example, the distance between the side edges 324 and the signal pins 166 may be selected to control the impedance of the signals.

Figure 12:
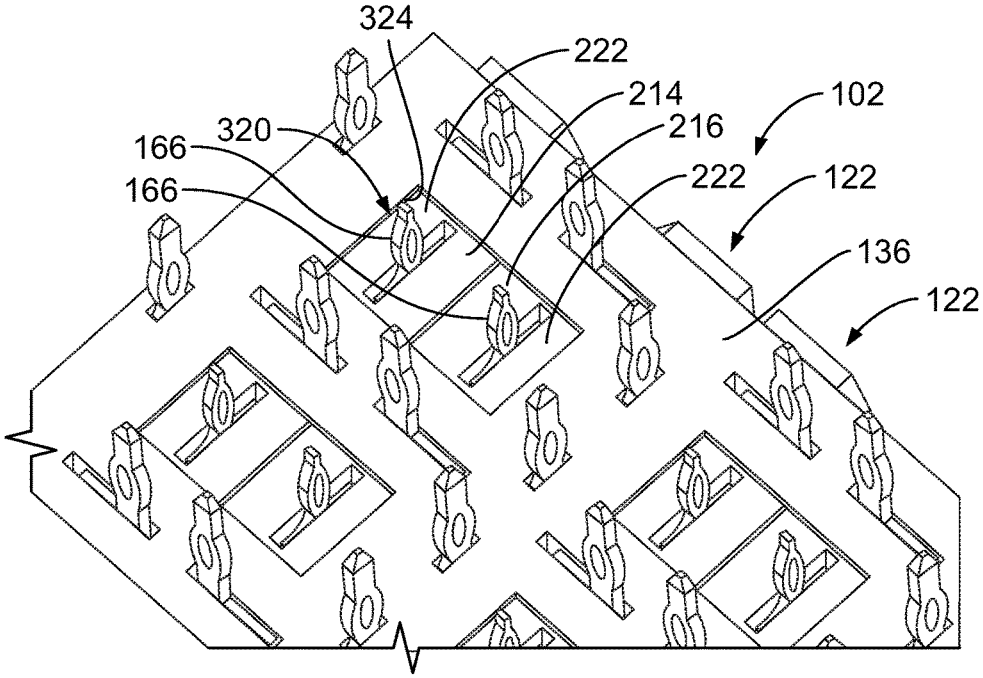
FIG. 12 is a bottom perspective view of a portion of the receptacle assembly showing the conductive pin organizer coupled to the contact modules.

FIG. 12 is a bottom perspective view of a portion of the receptacle assembly 102, showing the conductive pin organizer 136 coupled to the contact modules 122. In the embodiment shown in FIG. 12, the contact modules 122 include the signal pin spacers 222. When the conductive pin organizer 136 is coupled to the contact modules 122, the signal pin spacers 222 extend into the signal openings 320. The signal pin spacers 222 extend into the gaps 328 (FIG. 11) such that the gaps 328 are substantially filled with dielectric material of the dielectric frames 214, 216 of the contact modules 122. The signal pin spacers 222 electrically isolate the signal pins 166 from the conductive pin organizer 136. For example, the signal pin spacers 222 isolate the signal pins 166 from the side edges 324 of the signal openings 320. The signal pin spacers 222 provide additional support for the signal pins 166 (for example, side-to-side support), such as for locating the signal pins 166 for mating to the circuit board 106 (shown in FIG. 1). The signal pin spacers 222 may provide additional support to the signal pins 166 to prevent buckling during mating with the circuit board 106. The material of the signal pin spacers 222 affects the signal integrity and electrical performance of the signal pins 166 passing through the conductive pin organizer 136. For example, the material of the signal pin spacers 222 may affect the impedance of the signals passing through the conductive pin organizer 136.

Figure 13:
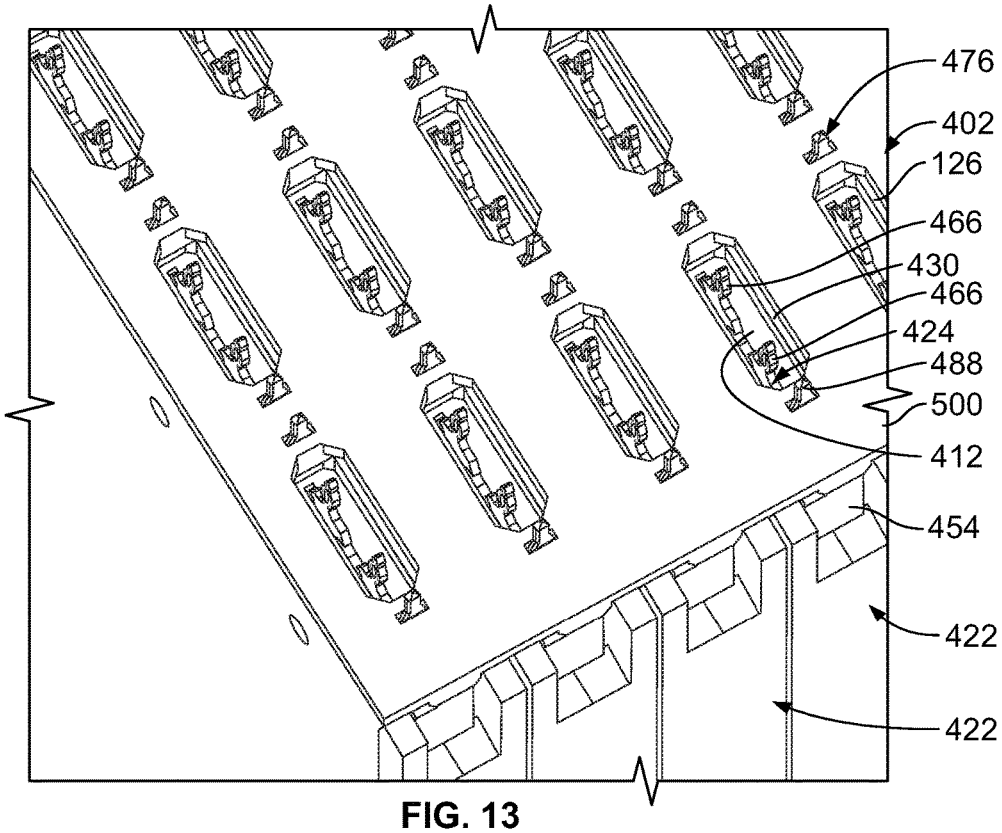
FIG. 13 is a bottom perspective view of a connector assembly having a pair-in-column signal contact arrangement and a corresponding conductive pin organizer.
Figure 14:
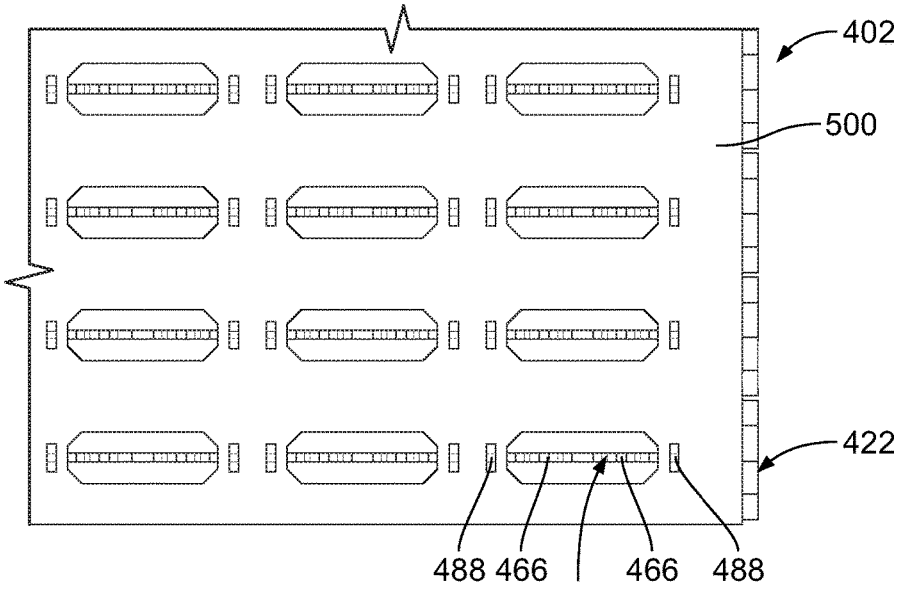
FIG. 14 is a bottom view of the connector assembly and the conductive pin organizer.

FIG. 13 is a bottom perspective view of a connector assembly 402 having a pair-in-column signal contact arrangement and a corresponding conductive pin organizer 500. FIG. 14 is a bottom view of the connector assembly 402 and the conductive pin organizer 500. The connector assembly 402 is similar to the connector assembly 102 having the pair-in-row signal contact arrangement and includes similar components.

The connector assembly 402 includes contact modules 422 having signal contacts 424 defining signal pins 466 at a bottom 430 of the connector assembly 402. Optionally, the signal contacts 424 may be arranged in pairs carrying differential signals. In the illustrated embodiment, the pairs of signal contacts 424 are arranged in the same column (pair-in-column arrangement) and are part of the same contact module 422.

Each contact module 422 has a shield structure 426 for providing electrical shielding for the signal contacts 424. The conductive pin organizer 500 forms part of the shield structure 426. In an exemplary embodiment, the contact module 422 includes a conductive holder 454 that defines at least a portion of the shield structure 426. In an exemplary embodiment, each contact module 422 includes at least one ground shield 476 that defines at least a portion of the shield structure 426. The ground shield 476 includes ground pins 488 that extend below the bottom 430 of the connector assembly 402.

Each contact module 422 includes a frame assembly 412, which includes the signal contacts 424. The frame assembly 412 may be an overmolded leadframe. The frame assembly 412 is held in the conductive holder 454. The conductive pin organizer 500 is coupled to the contact modules 422 below the conductive holder 454 and below the frame assembly 412. The signal pins 466 extending from the bottom of the frame assembly 412 are configured to pass through the conductive pin organizer 500 for termination to a circuit board.

Figure 15:
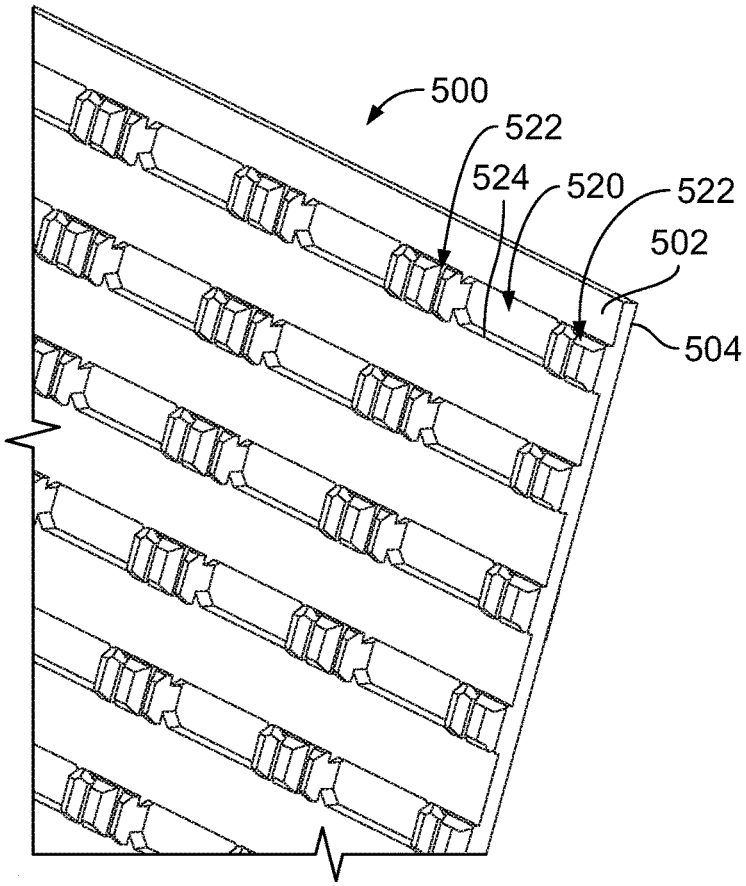
FIG. 15 is a top perspective view of the conductive pin organizer formed in accordance with an exemplary embodiment.
Figure 16:
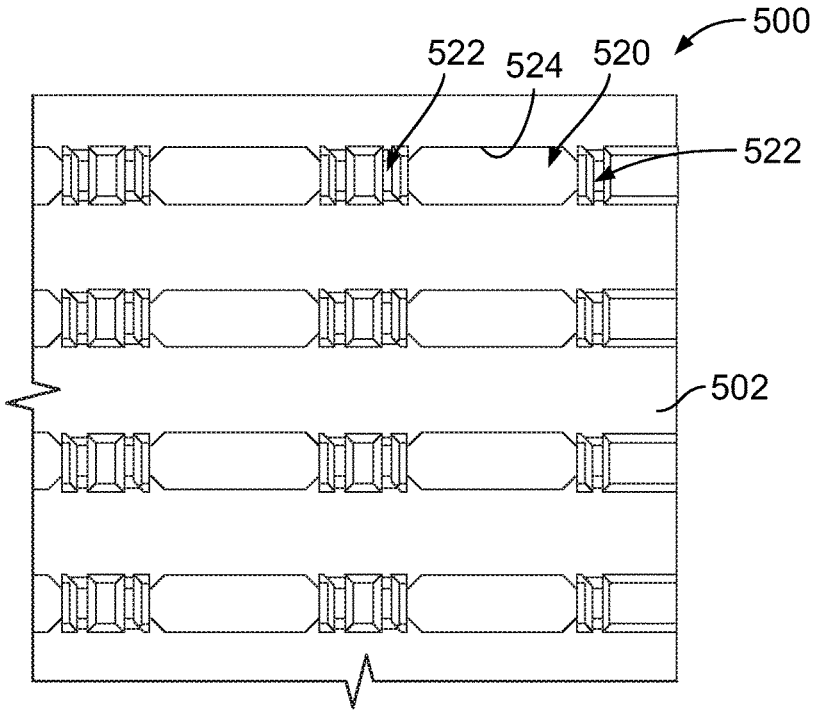
FIG. 16 is a top view of the conductive pin organizer.

FIG. 15 is a top perspective view of the conductive pin organizer 500 formed in accordance with an exemplary embodiment. FIG. 16 is a top view of the conductive pin organizer 500. The conductive pin organizer 500 includes a base or plate 500 having a top 502 and a bottom 504. The conductive pin organizer 500 is conductive to provide electrical shielding for the signal pins 466 (shown in FIG. 13) passing through the conductive pin organizer 500.

The conductive pin organizer 500 includes a plurality of signal openings 520 and ground pin holes 522 extending through the plate 500 between the top 502 and bottom 504. The signal openings 520 receive corresponding signal pins 466 and the ground pin holes 522 receive corresponding ground pins 488 (shown in FIG. 13). The conductive pin organizer 500 may hold the positions of the pins 466, 488 for mounting to the circuit board. In an exemplary embodiment, the signal openings 520 are oversized relative to the ground pin holes 522. For example, the signal openings 520 are designed to accommodate a corresponding pair of the signal pins 466. The signal openings 520 are oversized relative to the corresponding signal pins 466 to ensure that the conductive pin organizer 500 remains spaced apart from the signal pins 466 to avoid short circuiting and to control signal integrity of the signals. For example, the signal openings 520 are defined by side edges 524. The side edges 524 are configured to be electrically isolated from the signal pins 466.

Figure 17:
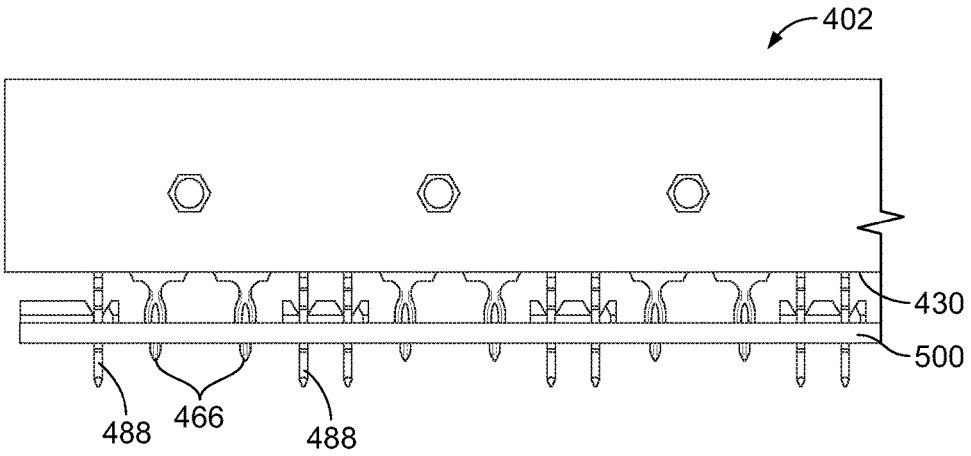
FIG. 17 is a side view of a portion of the connector assembly in accordance with an exemplary embodiment showing the conductive pin organizer in an intermediate position.
Figure 18:
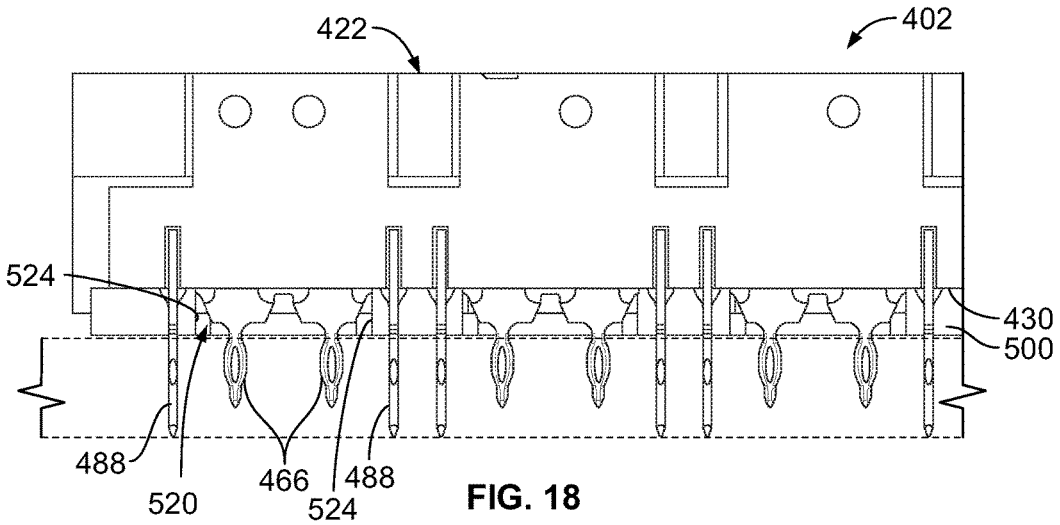
FIG. 18 is a side, partial sectional view of a portion of the connector assembly in accordance with an exemplary embodiment showing the conductive pin organizer in a fully mated position.

FIG. 17 is a side view of a portion of the connector assembly 402 in accordance with an exemplary embodiment showing the conductive pin organizer 500 in an intermediate position, such as a position used for shipping to protect the pins 466, 488. FIG. 18 is a side, partial sectional view of a portion of the connector assembly 402 in accordance with an exemplary embodiment showing the conductive pin organizer 500 in a fully mated position, such as a position used for mounting to a circuit board (shown in phantom). The conductive pin organizer 500 is configured to substantially fill a space between the bottoms of the contact modules 422 and the circuit board to provide electrical shielding for the signal pins 466 between the bottoms of the contact modules 422 and the circuit board.

In the intermediate position, the conductive pin organizer 500 is spaced apart from the bottom 430 of the connector assembly 402 and the pins 466, 488 pass through the conductive pin organizer 500. The conductive pin organizer 500 protects the pins 466, 488.

In the fully mated position, the conductive pin organizer 500 is pressed against the bottom 430 of the connector assembly 402. The pins 466, 488 pass through the conductive pin organizer 500. The ground pins 488 may be electrically connected to the conductive pin organizer 500. The signal pins 466 are electrically isolated from the conductive pin organizer 500. For example, the signal openings 520 are large enough to accommodate the signal pins 466 such that the signal pins 466 are spaced apart from the conductive pin organizer 500 and gaps are formed between the side edges 524 and the signal pins 466. In alternative embodiments, portions of the dielectric frames may surround the signal pins 466 and extend into the signal openings 520 to isolate the signal pins 466 from the conductive pin organizer 500.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector assembly comprising:

a housing;

a plurality of contact modules received in the housing, each contact module having a plurality of signal contacts, the signal contacts each including a signal pin for terminating to a circuit board, the signal pins extending from a bottom of the corresponding contact module, each contact module includes a dielectric frame holding a plurality of the signal contacts, the signal pins extending below the dielectric frame, each contact module includes a conductive holder holding the dielectric frame and providing shielding for the signal contacts, the conductive holder having a bottom, the conductive pin organizer engaging the bottom to electrically connect the conductive pin organizer to the conductive holder, each contact module having a ground shield providing electrical shielding for the signal contacts, the ground shield having a plurality of ground pins extending from a bottom of the ground shield for terminating to the circuit board; and a conductive pin organizer coupled to the contact modules, the conductive pin organizer having a plurality of ground pin holes extending therethrough receiving corresponding ground pins, the conductive pin organizer having signal openings extending therethrough receiving corresponding signal pins, the signal openings being defined by side edges, the side edges being electrically isolated from the signal pins;

wherein the conductive pin organizer substantially fills a space between the bottoms of the contact modules and the circuit board to provide electrical shielding for the signal pins between the bottoms of the contact modules and the circuit board.

2. The connector assembly of claim 1, wherein the conductive pin organizer engages the ground pins to electrically common the ground pins to the conductive pin organizer and hold relative positions of the ground pins.

3. The connector assembly of claim 1, wherein gaps are provided around the signal pins between the signal pins and the side edges of the signal openings.

4. The connector assembly of claim 3, wherein the gaps are substantially filled with dielectric material of the contact modules.

5. The connector assembly of claim 1, wherein the signal contacts are arranged in pairs, each signal opening receiving a corresponding pair of the signal contacts, the conductive pin organizer separating the pairs of signal pins from each other.

6. The connector assembly of claim 1, wherein the conductive pin organizer includes a top facing the bottoms of the contact modules and a bottom facing the circuit board.

7. The connector assembly of claim 6, wherein the top engages the bottoms of the contact modules to locate the conductive pin organizer relative to the contact modules.

8. The connector assembly of claim 1, wherein the dielectric frame includes signal pin spacers at a bottom of the dielectric frame associated with corresponding signal pins, the signal pin spacers extending along portions of the signal pins, the signal pin spacers being received in corresponding signal openings to electrically isolate the signal pins from the conductive pin organizer.

9. The connector assembly of claim 1, wherein the ground shield is electrically coupled to the conductive holder, the ground pins extending below the bottom of the conductive holder.

10. A connector assembly comprising:

a housing;

contact modules coupled to the housing, each contact module comprising:

a conductive holder holding a frame assembly, the frame assembly comprising a plurality of signal contacts arranged in pairs and a dielectric frame supporting the signal contacts, the dielectric frame being received in the conductive holder, the signal contacts each including a signal pin for terminating to a circuit board, the signal pins extending from a bottom of the contact module; and a ground shield coupled to the conductive holder, the ground shield being electrically connected to the conductive holder, the ground shield having ground pins extending beyond the bottom of the contact module for terminating to the circuit board; and a conductive pin organizer coupled to the contact modules and being electrically connected to the conductive holders of the contact modules, the conductive pin organizer having a plurality of ground pin holes extending therethrough receiving corresponding ground pins, the conductive pin organizer having signal openings extending therethrough each receiving corresponding pairs of signal pins, the signal openings being defined by side edges, the side edges being electrically isolated from the signal pins, the conductive pin organizer separating the pairs of signal pins from each other;

wherein the conductive pin organizer substantially fills a space between the bottoms of the contact modules and the circuit board to provide electrical shielding for the signal pins between the bottoms of the contact modules and the circuit board.

11. The connector assembly of claim 10, wherein the conductive pin organizer engages the ground pins and holds relative positions of the ground pins.

12. The connector assembly of claim 10, wherein gaps are provided around the signal pins between the signal pins and the side edges of the signal openings.

13. The connector assembly of claim 12, wherein the gaps are substantially filled with dielectric material of the contact modules.

14. The connector assembly of claim 10, wherein the conductive pin organizer includes a top facing the bottoms of the contact modules and a bottom facing the circuit board, the top engages the bottoms of the contact modules to locate the conductive pin organizer relative to the contact modules.

15. The connector assembly of claim 10, wherein the dielectric frame includes signal pin spacers at a bottom of the dielectric frame associated with corresponding signal pins, the signal pin spacers extending along portions of the signal pins, the signal pin spacers being received in corresponding signal openings to electrically isolate the signal pins from the conductive pin organizer.

16. A conductive pin organizer for a connector assembly having a plurality of signal pins arranged in pairs and a plurality of ground pins extending from a bottom of the connector assembly, the conductive pin organizer comprising:

a plate having a top, a bottom, a front, a rear and opposite sides with edges extending between the top and bottom along the front, rear and sides;

a plurality of ground pin holes extending through the plate between the top and bottom, the ground pin holes being configured to receive corresponding ground pins of the connector assembly; and a plurality of signal openings extending through the plate between the top and bottom, each of the signal openings being sized and shaped and configured to receive a corresponding pair of signal pins of the connector assembly, the plate being spaced apart from the signal pins as the pairs of signal pins pass through the plate to electrically isolate the plate from the pairs of signal pins.

17. The conductive pin organizer of claim 16, wherein the signal openings form gaps around the signal pins between the signal pins and side edges defining the signal openings.

18. The conductive pin organizer of claim 16, wherein the signal openings are sized and shaped to receive dielectric material of a dielectric frame holding the signal pins in addition to the pairs of signal pins to electrically isolate the plate from the signal pins.

* * * * *